US011571737B2

(12) United States Patent
Tsujimoto et al.

(10) Patent No.: US 11,571,737 B2
(45) Date of Patent: Feb. 7, 2023

(54) AQUEOUS COMPOSITION

(71) Applicant: MORESCO CORPORATION, Hyogo (JP)

(72) Inventors: Takahito Tsujimoto, Hyogo (JP); Hiroaki Tomimatsu, Hyogo (JP); Teruaki Yokoo, Hyogo (JP)

(73) Assignee: MORESCO CORPORATION, Hyogo (JP)

( * ) Notice: Subject to any disclaimer, the term of this patent is extended or adjusted under 35 U.S.C. 154(b) by 0 days.

(21) Appl. No.: 17/255,633

(22) PCT Filed: Jun. 21, 2019

(86) PCT No.: PCT/JP2019/024636
§ 371 (c)(1),
(2) Date: Dec. 23, 2020

(87) PCT Pub. No.: WO2020/004245
PCT Pub. Date: Jan. 2, 2020

(65) Prior Publication Data

US 2021/0276075 A1 Sep. 9, 2021

(30) Foreign Application Priority Data

Jun. 26, 2018 (JP) ..... JP2018-120685

(51) Int. Cl.

| | |
|---|---|
| ***C10M 173/00*** | (2006.01) |
| ***B22C 3/00*** | (2006.01) |
| ***C10M 169/00*** | (2006.01) |
| ***C10M 105/30*** | (2006.01) |
| *C10N 40/20* | (2006.01) |

(52) U.S. Cl.
CPC ..... *B22C 3/00* (2013.01); *C10M 105/30* (2013.01); *C10M 169/00* (2013.01); *C10M 173/00* (2013.01); *C10N 2040/20* (2013.01)

(58) Field of Classification Search
CPC ..... B22C 3/00; C10M 103/00; C10M 173/00; C10M 2201/02; C10M 105/30; C10M 169/00; C10M 105/26; C10M 173/02; C10N 2040/20; B22D 17/20
See application file for complete search history.

(56) References Cited

U.S. PATENT DOCUMENTS

| | | | | |
|---|---|---|---|---|
| 4,419,253 | A * | 12/1983 | Kennedy | C10M 135/02 508/506 |
| 4,454,050 | A | 6/1984 | Bertell | |
| 4,765,917 | A | 8/1988 | Otaki et al. | |
| 2001/0031707 | A1 | 10/2001 | Maeda et al. | |
| 2011/0042029 | A1 | 2/2011 | Furukawa et al. | |

FOREIGN PATENT DOCUMENTS

| | | | | |
|---|---|---|---|---|
| GB | 2 046 298 | | 11/1980 | |
| GB | 2046298 | A * | 11/1980 | C10M 173/02 |
| JP | 55-139498 | | 10/1980 | |
| JP | 63-89592 | | 4/1988 | |
| JP | 1-299896 | | 12/1989 | |
| JP | 4-238643 | | 8/1992 | |
| JP | 2001-259788 | | 9/2001 | |
| JP | 2002-205139 | | 7/2002 | |
| JP | 2007-118035 | | 5/2007 | |
| JP | 2010-84076 | | 4/2010 | |
| JP | 2010-89140 | | 4/2010 | |
| JP | 2011-42709 | | 3/2011 | |

OTHER PUBLICATIONS

Notice of Reasons for Refusal dated Jun. 8, 2021 in corresponding Japanese Patent Application No. 2020-527471, with Machine Translation.
Notice of Reasons for Refusal dated Oct. 5, 2021 in corresponding Japanese Patent Application No. 2020-527471, with Machine Translation.
Notice of Submission of Publications dated Sep. 14, 2021 in corresponding Japanese Patent Application No. 2020-527471, with Machine Translation.
International Search Report dated Sep. 17, 2019 in International (PCT) Application No. PCT/JP2019/024636.

* cited by examiner

*Primary Examiner* — Taiwo Oladapo
(74) *Attorney, Agent, or Firm* — Wenderoth, Lind & Ponack, L.L.P.

(57) ABSTRACT

According to an aspect of the present invention, an aqueous composition contains at least one selected from a group consisting of a carboxylic acid compound represented by the following formula (1), a carboxylic anhydride represented by the following formula (2), and a trimellitic anhydride; a basic compound; and water. In the formula (1), "R" represents an alkanediyl group having 2 to 4 carbons, a vinylene group, or a benzene ring, and "a" represents 2 or 3. In the formula (2), "R" represents an alkanediyl group having 2 to 4 carbons, a vinylene group, or a benzene ring.

2 Claims, No Drawings

AQUEOUS COMPOSITION

TECHNICAL FIELD

The present invention relates to an aqueous composition.

BACKGROUND ART

As a metal forming method using a mold, there are a casting method, a die forging method, and the like. Further, as a casting method, for example, there are a low pressure casting method, a die casting method, and the like. In these metal forming methods using a mold, an aqueous composition, an oily composition, a powdery composition, a granular composition, and the like are likely to be applied over a mold as a release agent in advance prior to forming in order to facilitate taking-out of a metal product (molded product) from the mold after forming. Specifically, in casting methods, an aqueous composition, an oily composition, a powdery composition, a granular composition, and the like are applied over a mold in advance prior to filling the mold with a melted metal for the purpose of suppressing the mold and the melted metal (molten metal) from adhering to each other, and assisting release of the molded product from the mold.

In metal forming methods using a mold, a molten metal is flowed into the mold before the mold forming. For example, in a die casting method and the like, a molten metal is flowed into a sleeve connected with an inside of the mold, and the molten metal is then transferred into the mold from the sleeve by sliding a plunger in the sleeve. In this case, an aqueous composition, an oily composition, a powdery composition, a granular composition, and the like are likely to be placed between the plunger and the sleeve as a lubricant for the purpose of reducing an abrasion in sliding contact surfaces of the plunger and the sleeve, and stabilizing an injection velocity of the plunger.

As an aqueous composition used as a release agent, a lubricant, and the like in metal forming methods using a mold, an aqueous composition containing a silicone oil as a main component can be raised. It has been inferred that the aqueous composition containing a silicone oil as a main component has an improved releasability and lubricity because of a high heat resistance of the silicon oil. Further, developments have been conducted for modification of a silicone and additives for a silicone oil in order to enhance the releasability and the lubricity of an aqueous composition containing a silicone oil as a main component.

A die casting method using an aqueous composition containing a silicone oil as a release agent is, for example, disclosed in Patent Literature 1.

Patent Literature 1 discloses a die casting method including a step of spraying a high concentration aqueous release agent for die casting having a content (in terms of a solid content) of 5 to 60 mass % of releasing component such as a silicone compound onto a mold in such a manner as to fulfill a predetermined condition. According to Patent Literature 1, a high concentration aqueous release agent for die casting can be used in an extremely small amount without dilution with water. This consequently improves the drying efficiency in a mold, further enabling a significant reduction of waste liquid derived from a release agent compared with a conventional die casting method, and thereby remedying problems of environmental pollution such as water pollution.

Further, as an aqueous composition other than aqueous compositions containing a silicone oil as a main component for use in metal forming methods using a mold, there are a mold release agent disclosed in Patent Literature 2 and the like.

Patent Literature 2 discloses a water soluble mold release agent to be applied over a forming surface of a mold, and it contains an organic acid or an organic acid salt having a reducibility at a concentration of 0.01 wt % or more when being used and at a ratio of a fixed concentration which is a stability limit of mold release agent emulsion or lower as an undiluted concentration. According to Patent Literature 2, a forming surface quality of a mold is improved by repeated casting cycles, and the life of the mold can be thus extended remarkably.

CITATION LIST

Patent Literature

Patent Literature 1: Japanese Unexamined Patent Publication No. 2010-89140

Patent Literature 2: Japanese Unexamined Patent Publication No. 2007-118035

SUMMARY OF INVENTION

An object of the present invention is to provide an aqueous composition excellent in releasability, lubricity, adhesion, and heat resistance, and having a low odorousness.

According to an aspect of the present invention, an aqueous composition comprises at least one selected from a group consisting of a carboxylic acid compound represented by the following formula (1), a carboxylic anhydride represented by the following formula (2), and a trimellitic anhydride; a basic compound; and water.

[Chemical Formula 1]

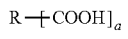

$$R\text{—}[COOH]_a \quad (1)$$

In the formula (1), "R" represents an alkanediyl group having 2 to 4 carbons, a vinylene group, or a benzene ring, and "a" represents 2 or 3.

[Chemical Formula 2]

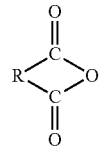

(2)

In the formula (2), "R" represents an alkanediyl group having 2 to 4 carbons, a vinylene group, or a benzene ring.

The foregoing and other objects, features, and advantages of the present invention will be clarified by the following detailed description.

DESCRIPTION OF EMBODIMENTS

In metal forming methods using a mold, for example, in a die casting method, a release coating is formed on a surface of a mold by applying a relatively large amount from several hundred milliliters or several liters of a release agent which diluted in about 100 times over the mold, and then a mold is cooled. This makes it possible to form a metal product (molded product) in the mold, and separate the metal product from the mold.

However, according to study of the present inventers, in a case where an aqueous composition containing a silicone as a main component, for example, the release agent disclosed in Patent Literature 1 was used as a release agent for use in a metal forming method using a mold, the release agent was likely to accumulate in a cavity of the mold and contaminate the mold, consequently making it difficult to wash off. Further, a molded product obtained by use of an insufficiently washed mold was likely to be improper to be used as an electronic part and the like. Further, in a case where an aqueous composition had a low heat resistance and the mold temperature was high, a release agent was likely to gasify upon coming into contact with the mold, and the generated gas consequently caused an internal defect such as a blowhole. Besides, in a case where a aqueous composition was used as a release agent, a releasing component was likely to insufficiently adhere to the mold.

In view thereof, it can be conceived to use, as a release agent, an aqueous composition other than the aqueous compositions containing a silicone as a main component, for example, the mold release agent disclosed in Patent Literature 2.

However, according to study of the present inventors, the mold release agent disclosed in Patent Literature 2 has been found not to be excellent in releasability, lubricity, adhesion, or heat resistance, and to be likely to have a high odorousness. In other words, the release agent disclosed in Patent Literature 2 has been found not to be excellent in releasability, lubricity, adhesion, or heat resistance, and having a low odorousness.

The present invention has been made in view of the problems, and has an object to provide an aqueous composition excellent in releasability, lubricity, adhesion, and heat resistance, and having a low odorousness.

Hereinafter, embodiments according to the present invention will be described. However, the present invention should not be limited thereto.

An aqueous composition according to an embodiment of the present invention comprises: at least one selected from a group consisting of a carboxylic acid compound represented by the following formula (1), a carboxylic anhydride represented by the following formula (2), and a trimellitic anhydride; a basic compound; and water.

[Chemical Formula 3]

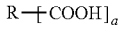

(1)

In the formula (1), "R" represents an alkanediyl group having 2 to 4 carbons, a vinylene group, or a benzene ring, and "a" represents 2 or 3.

[Chemical Formula 4]

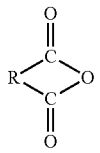

(2)

In the formula (2), "R" represents an alkanediyl group having 2 to 4 carbons, a vinylene group, or a benzene ring.

The aqueous composition is excellent in releasability, lubricity, adhesion, and heat resistance, and has a low odorousness. Specifically, the aqueous composition can have sufficiently high releasability and lubricity because it contains the carboxylic acid compound and the basic compound. Thus, this composition can be used as a release agent and a lubricant in a metal forming method using a mold such as a die casting method. Specifically, this composition can be used as a release agent to be applied over a mold in advance, for example, a release agent for die casting. Besides, this composition can be used as a lubricant for enhancing the lubricity between a sleeve for allowing a molten metal to flow into a mold and a plunger for transferring the molten metal, for example, a plunger lubricant for die casting, a sleeve lubricant for die casting, and the like. Since the aqueous composition is excellent also in adhesion and heat resistance, when used as a release agent and a lubricant as described above, the aqueous composition can yield a further enhanced releasability and lubricity. Besides, even when used as a release agent and a lubricant as described above, the aqueous composition generates less odor, and can prevent deterioration of working environment and the like.

The carboxylic acid compound is represented by the following formula (1), wherein "R" represents an alkanediyl group having 2 to 4 carbons, a vinylene group, or a benzene ring, and "a" being a substitution degree (the number of carboxyl groups) of carboxyl groups (—COOH) represents 2 or 3. Namely, the carboxylic acid compound is a carboxylic acid compound having an alkanediyl group having 2 to 4 carbons, a vinylene group or a benzene ring substituted with two or three carboxyl groups.

As the carboxylic acid compound, for example, there are succinic acid, adipic acid, maleic acid, fumaric acid, phthalic acid, isophthalic acid, terephthalic acid, and trimellitic acid, and the like. The use of these carboxylic acid compounds makes an aqueous composition more excellent in releasability, lubricity, adhesion, and heat resistance, and have a lower odorousness. Further, among the carboxylic acid compounds raised above, adipic acid, terephthalic acid, and trimellitic acid are more preferable carboxylic acid compounds. In a case where the aqueous composition is used as a release agent in a metal forming method using a mold, for example, in a die casting method, an obtained molded product is likely to be colored. The occurrence of coloration can be suppressed by making the carboxylic acid compound contain at least one selected from a group consisting of adipic acid, terephthalic acid, and trimellitic acid. In other words, it is possible to obtain an aqueous composition not only excellent in releasability, lubricity, adhesion, and heat resistance, and having a low odorousness, but also excellent in the aspect of coloring resistance.

One of the carboxylic acid compounds may be singly used, or two or more compounds may be used in combination. As the carboxylic acid compound, there are an aliphatic carboxylic acid compound represented by the formula (1), wherein "R" represents an alkanediyl group having 2 to 4 carbons and a vinylene group; and an aromatic carboxylic acid compound represented by the formula (1), wherein "R" represents a benzene ring. In a case where two or more kinds of carboxylic acid compounds are used in combination, it is preferable, for example, to consist of an aliphatic carboxylic acid compound represented by the formula (1), wherein "R" represents an alkanediyl group having 2 to 4 carbons; and an aromatic carboxylic acid compound represented by the formula (1), wherein "R" represents a benzene ring. The use of these carboxylic acid compounds in combination makes it possible to obtain an aqueous composition more excellent in releasability, lubricity, adhesion, and heat resistance, and having a lower odorousness. Besides, it is more preferable that the aliphatic carboxylic acid is an adipic acid, and the aromatic carboxylic acid is a terephthalic acid. The use of these carboxylic acid compounds in combination makes it possible to obtain an aqueous composition not only more excellent in releasability, lubricity, adhesion, and heat resistance, and having a lower odorousness, but also excellent in the aspect of coloring resistance.

The carboxylic anhydride and the trimellitic anhydride are anhydrates of the carboxylic acid compound. The carboxylic anhydride is represented by the formula (2), wherein "R" represents an alkanediyl group having 2 to 4 carbons, a vinylene group, or a benzene ring. Namely, as the carboxylic anhydride, there are an aliphatic carboxylic anhydride represented by the formula (2), wherein "R" represents an alkanediyl group having 2 to 4 carbons and a vinylene group; and an aromatic carboxylic anhydride represented by the formula (2), wherein "R" represents a benzene ring.

As the carboxylic anhydride, for example, there are succinic anhydride, adipic anhydride, maleic anhydride, fumaric anhydride, phthalic anhydride, and the like. The use of these carboxylic anhydrides makes the aqueous composition more excellent in releasability, lubricity, adhesion, and heat resistance, and have a lower odorousness.

One of the carboxylic anhydrides may be singly used, or two or more anhydrides may be used in combination.

For the reasons described above, the aqueous composition comprises at least one selected from a group consisting of the carboxylic acid compound, the carboxylic anhydride, and the trimellitic anhydride. In other words, in the aqueous composition, one of the carboxylic acid compound, the carboxylic anhydride, and the trimellitic anhydride may be singly used, or two or more kinds may be used in combination.

The basic compound is not limited to a particular one as long as it is capable of neutralizing the carboxylic acid compound, the carboxylic anhydride, and the trimellitic anhydride. The basic compound may be either a basic organic compound or a basic inorganic compound. As the basic organic compound, for example, there are amine compounds such as: triethylamine, monoethylamine, diethylamine, trimethylamine, monomethylamine, dimethylamine, ethylenediamine, triethanolamine, and tetramethylethylenediamine; pyrrolidine; piperidine; pyridine; and the like. Besides, as the basic inorganic compound, for example, there are sodium hydroxide, potassium hydroxide, calcium hydroxide, magnesium hydroxide, sodium carbonate, sodium hydrogen carbonate, potassium carbonate, potassium hydrogen carbonate, calcium carbonate, magnesium carbonate, and the like. Among them, the basic compound is preferably a basic inorganic compound, and more preferably sodium hydroxide and potassium hydroxide from the viewpoint of having a low odorousness. Further, the sodium hydroxide is preferable from the viewpoint of being easily obtainable. One of the basic compounds may be singly used, or two or more compounds may be used in combination.

Water is not limited to a particular kind. There are a kind of water which is usable for an aqueous composition such as an aqueous release agent or an aqueous lubricant, and the like. Specifically, there are industrial water, ion-exchanged water, pure water, and the like.

A total content of the carboxylic acid compound, the carboxylic anhydride, and the trimellitic anhydride is preferably 3 to 30 mass %, more preferably 3 to 20 mass %, and further more preferably 3 to 15 mass % to a total amount of the aqueous composition. When the contents of the carboxylic acid compound, the carboxylic anhydride, and the trimellitic anhydride are too small, the lubricity and the releasability are likely to degrade. Besides, when the contents of the carboxylic acid compound, the carboxylic anhydride, and the trimellitic anhydride are too large, the carboxylic acid compound, the carboxylic anhydride, and the trimellitic anhydride are likely to precipitate from the aqueous composition, making the aqueous composition improper to be applied. Thus, an aqueous composition more excellent in releasability, lubricity, adhesion, and heat resistance, and having a lower odorousness can be obtained when the total content of the carboxylic acid compound, the carboxylic anhydride, and the trimellitic anhydride is within the aforementioned range.

The content of the basic compound is not limited to a particular one. However, for example, the basic compound is contained in such a manner that the aqueous composition has a pH of preferably 7 to 13, more preferably 7 to 10, and furthermore preferably 8. When the content of the basic compound is too small, the aqueous composition is likely to corrode the mold and the surrounding equipment. When the content of the basic compound is too large, the aqueous compound is likely to irritate more the operator's eyes and skin, thus is likely to be poorer in safety performance. Accordingly, it is possible to obtain an aqueous composition more excellent in releasability, lubricity, adhesion, and heat resistance, and having a lower odorousness when the content of the basic compound is within the aforementioned range.

In the aqueous composition, the remainder is the water. For example, in a case of an aqueous composition consisting of: at least one selected from a group consisting of the carboxylic acid compound, the carboxylic anhydride, and the trimellitic anhydride; a basic compound; and water, the component of aqueous composition other than the carboxylic acid compound, the carboxylic anhydride, the trimellitic anhydride, and the basic compound is water. Further, in a case where the aqueous composition contains another component other than the carboxylic acid compound, the carboxylic anhydride, the trimellitic anhydride, the basic compound, and the water, the component of the aqueous composition other than the carboxylic acid compound, the carboxylic anhydride, the trimellitic anhydride, the basic compound, and the other component is water.

The aqueous composition may contain components (other components) other than the carboxylic acid compound, the carboxylic anhydride, the trimellitic anhydride, the basic compound, and the water depending on the necessity as long as the other components do not affect the effects of the present invention. As the other components, there are a water-soluble polymer and the like. Further, the aqueous composition may be used in addition to a conventional aqueous release agent or aqueous lubricant such as an emulsion-type release agent or lubricant. Otherwise, the conventional aqueous release agent or aqueous lubricant such as an emulsion-type release agent or lubricant may be used in addition to the aqueous composition. In a case of an aqueous composition thus obtained, as the other components, there are a component contained in a conventional release agent or lubricant, and the like.

The water-soluble polymer is not limited to a particular one, and a water-soluble polymer usable for an aqueous composition such as an aqueous release agent and an aqueous lubricant, and the like can be raised. As the water-soluble polymer, specifically there are a cellulose derivative such as carboxymethyl cellulose (CMC) and hydroxyethyl cellulose (HEC), polyethylene glycol, an isobutylene-maleic acid copolymer, a diisobutylene-maleic acid copolymer, stylene-maleic acid copolymer, polyvinylpyrrolidone (PVP), and the like. Among them, the cellulose derivative is preferable, and carboxymethyl cellulose (CMC) and hydroxyethyl cellulose (HEC) are more preferable.

The water-soluble polymer may be contained, but is not necessarily contained in the aqueous composition. However, the aqueous composition has an increased lubricity and releasability because it contains the water-soluble polymer. In a case where the water-soluble polymer is contained, the content is preferably 0.1 to 10 mass %, and preferably 0.1 to 5 mass % to a total amount of the aqueous composition. When the content of the water-soluble polymer is too small, the aqueous composition is likely to insufficiently enhance the effect of addition of the water-soluble polymer. Besides, when the content of the water-soluble polymer is too large, the viscosity of the aqueous composition increases, thus the aqueous composition is likely to be improper to be applied.

The aqueous composition has a viscosity at 30° C. of preferably 100 mPa·s or less, and more preferably 50 mPa·s. When the viscosity in the aqueous composition is too high, the aqueous composition is likely to be improper to be applied.

The method for producing the aqueous composition is not limited to a particular one as long as the method makes it possible to produce the aqueous composition. Specifically, it is possible to produce the aqueous composition by introducing a carboxylic acid compound, a carboxylic anhydride, a trimellitic anhydride, a basic compound, and the other components into water in such a manner as to have a predetermined amount relative to the water, and mixing the solution.

As described above, the aqueous composition can have sufficiently high releasability and lubricity in a metal forming method using a mold, for example, a die casting method because it contains at least one selected from a group consisting of the carboxylic acid compound, the carboxylic anhydride, and the trimellitic anhydride, and the basic compound. Thus, the aqueous composition can be used as a release agent to be applied over a mold in advance, for example, a release agent for die casting. Besides, the aqueous composition can be used as a lubricant for enhancing the lubricity between a sleeve for allowing a molten metal to flow into a mold and a plunger for transferring the molten metal, for example, a plunger lubricant for die casting, a sleeve lubricant for die casting, and the like. Since the aqueous composition is excellent also in adhesion and heat resistance, when used as a release agent and a lubricant as described above, the aqueous composition can yield a further enhanced releasability and lubricity. Besides, even when used as a release agent and a lubricant as described above, the aqueous composition generates less odor, and can prevent deterioration of working environment and the like.

The present specification discloses the technologies in various modes as described above. The main technologies thereof are summarized hereinafter.

According to an aspect of the present invention, an aqueous composition comprises at least one selected from a group consisting of a carboxylic acid compound represented by the following formula (1), a carboxylic anhydride represented by the following formula (2), and a trimellitic anhydride; a basic compound; and water.

[Chemical Formula 5]

(1)

In the formula (1), "R" represents an alkanediyl group having 2 to 4 carbons, a vinylene group, or a benzene ring, and "a" represents 2 or 3.

[Chemical Formula 6]

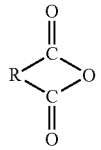

(2)

In the formula (2), "R" represents an alkanediyl group having 2 to 4 carbons, a vinylene group, or a benzene ring.

According to this configuration, it is possible to provide an aqueous composition excellent in releasability, lubricity, adhesion, and heat resistance, and having a low odorousness.

Further, in the aqueous composition, the carboxylic acid compound is preferably at least one selected from a group consisting of a succinic acid, an adipic acid, a maleic acid, a fumaric acid, a phthalic acid, an isophthalic acid, a terephthalic acid, and a trimellitic acid. Further, the carboxylic anhydride is preferably at least one selected from a group consisting of a succinic anhydride, an adipic anhydride, a maleic anhydride, and a phthalic anhydride.

According to this configuration, it is possible to obtain an aqueous composition more excellent in releasability, lubricity, adhesion, and heat resistance, and having a lower odorousness.

Besides, in the aqueous composition, the carboxylic acid compound is more preferably at least one selected from a group consisting of an adipic acid, a terephthalic acid, and a trimellitic acid.

According to this configuration, the aqueous composition is excellent also in the aspect of coloring resistance. In other words, in a case where the present aqueous composition is used as a release agent in a metal forming method using a mold such as a die casting method, the aqueous composition can sufficiently suppress the obtained molded product from being colored. Thus, it is possible to obtain an aqueous composition not only excellent in releasability, lubricity, adhesion, and heat resistance, and having a low odorousness, but also excellent in the aspect of coloring resistance.

Besides, in the aqueous composition, the carboxylic acid compound preferably consists of: an aliphatic carboxylic acid compound represented by the formula (1), wherein "R" represents an alkanediyl group having 2 to 4 carbons; and an aromatic carboxylic acid compound represented by the formula (1), wherein "R" represents a benzene ring.

According to this configuration, it is possible to obtain an aqueous composition more excellent in releasability, lubricity, adhesion, and heat resistance, and having a lower odorousness.

Besides, in the aqueous composition, it is more preferable that the aliphatic carboxylic acid is an adipic acid, and the aromatic carboxylic acid is a terephthalic acid.

According to this configuration, it is possible to obtain an aqueous composition not only more excellent in releasability, lubricity, adhesion, and heat resistance, and having a lower odorousness, but also excellent in the aspect of coloring resistance.

Besides, in the aqueous composition, a total content of the carboxylic acid compound, the carboxylic anhydride, and the trimellitic anhydride is preferably 3 to 30 mass % to a total amount of the aqueous composition.

According to this configuration, it is possible to obtain an aqueous composition more excellent in releasability, lubricity, adhesion, and heat resistance, and having a lower odorousness.

According to the present invention, it is possible to provide an aqueous composition excellent in releasability, lubricity, adhesion, and heat resistance, and having a low odorousness.

Hereinafter, the present invention will be further specifically described by means of Examples. However, the scope of the present invention should not be limited thereto.

EXAMPLES

Examples 1 to 18, Comparative Examples 1 to 14

Each component used for preparing an aqueous composition in the present Examples will be described.

[Carboxylic Acid Compound Represented by the Formula (1), Wherein "R" Represents a Vinylene Group, and the Substitution Degree "a" Represents 2]

Maleic acid: HOOC—CHCH—COOH (in cis position) (Maleic acid produced by Tokyo Chemical Industry Co., Ltd.)

Fumaric acid: HOOC—CHCH—COOH (in trans position) (Fumaric acid produced by FUSO CHEMICAL CO., LTD.)

[Aliphatic Carboxylic Acid Compound Represented by the Formula (1), Wherein "R" Represents an Alkanediyl Group Having 2 to 4 Carbons, and the Substitution Degree "a" Represents 2]

Succinic acid: HOOC—$(CH_2)_2$—COOH (Succinic acid SA produced by NIPPON SHOKUBAI CO., LTD.)

Adipic acid: HOOC—$(CH_2)_4$—COOH (Adipic Acid produced by BASF Japan Ltd.)

[Aromatic Carboxylic Acid Compound Represented by the Formula (1), Wherein "R" Represents a Benzene Ring, and the Substitution Degree "a" Represents 2]

Phthalic acid: HOOC—$C_6H_4$—COOH (in ortho position) (Phthalic acid produced by Tokyo Chemical Industry Co., Ltd.)

Isophthalic acid: HOOC—$C_6H_4$—COOH (in meta position) (Isophthalic acid produced by LOTTE Chemical CORPORATION)

Terephthalic acid: HOOC—$C_6H_4$—COOH (in para position) (Terephthalic acid produced by Toray Industries, Inc.)

[Aromatic Carboxylic Acid Compound Represented by the Formula (1), Wherein "R" Represents a Benzene Ring, and the Substitution Degree "a" Represents 3]

Trimellitic acid: $C_6H_3$—$(COOH)_3$ (Trimellitic acid produced by Tokyo Chemical Industry Co., Ltd.)

[Aliphatic Carboxylic Anhydride Represented by the Formula (2), Wherein "R" Represents an Alkanediyl Group Having 2 to 4 Carbons]

Succinic anhydride: Succinic anhydride produced by Tokyo Chemical Industry Co., Ltd.

Adipic anhydride: Adipic anhydride produced by FUJIFILM Wako Pure Chemical Corporation

[Carboxylic Anhydride Represented by the Formula (2), Wherein "R" Represents a Vinylene Group]

Maleic anhydride: MA produced by Excel Chemical Co., Ltd.

[Aromatic Carboxylic Anhydride Represented by the Formula (2), Wherein "R" Represents a Benzene Ring]

Phthalic anhydride: Phthalic anhydride produced by Kawasaki Kasei Chemicals Ltd.)

[Trimellitic Anhydride]

Trimellitic anhydride: Trimellitic anhydride produced by MITSUBISHI GAS CHEMICAL COMPANY, INC.

[Carboxylic Acid Compound Other than Those Described Above]

Formic acid: HCOOH (Formic acid produced by FUJIFILM Wako Pure Chemical Corporation)

Pelargonic acid: $CH_3(CH_2)_7COOH$ (Matrilox-IP001M produced by Matrica S.p.A.) Oleic acid: $CH_3(CH_2)_7CH{=}CH(CH_2)_7COOH$ (LUNAC O-V produced by Kao Corporation)

DL-Malic acid: HOOC—CH(OH)—$CH_2$—COOH (DL-Malic acid produced by FUSO CHEMICAL CO., LTD.)

Citric acid: $C(OH)(CH_2COOH)_2COOH$ (Citric acid produced by KOMATSUYA CORPORATION)

L-tartaric acid: $(CH(OH)COOH)_2$ (L-tartaric acid produced by DSP GOKYO FOOD & CHEMICAL Co., Ltd.)

Oxalic acid: HOOC—COOH (Oxalic acid (dihydrate) produced by Ube Industries, Ltd.) Azelaic acid: HOOC—$(CH_2)_7$—COOH (CRODACID DC1195-FL-(SI) produced by Croda Japan KK)

Sebacic acid: HOOC—$(CH_2)_8$—COOH (Sebacic acid SR produced by ITOH OIL CHEMICALS CO., LTD.)

Dodecanedioic acid: HOOC—$(CH_2)_{10}$—COOH (Dodecanedioic acid produced by INVISTA Japan LLC)

Benzoic acid: $C_6H_5COOH$ (Benzoic acid produced by FUSHIMI Pharmaceutical Co., Ltd.)

Salicylic acid: $C_6H_4(OH)COOH$ (Salicylic acid produced by Solvay Japan, Ltd.)

Gallic acid: $C_6H_2(OH)_3COOH$ (Gallic acid produced by DSP GOKYO FOOD & CHEMICAL Co., Ltd.)

[Basic Compound]

30 mass % of sodium hydroxide solution: 30% caustic soda produced by Shin Nihon Techno Kabushiki Kaisha

[Water-Soluble Polymer]

CMC: carboxymethyl cellulose (SG CELLOGEN PR produced by DKS Co. Ltd.)

HEC: hydroxyethyl cellulose (HEC Daicel SP200 produced by Daicel FineChem Ltd.)

[Water]

Water: ion-exchanged water

Silicone: Alkyl and aralkyl modified silicone (RELEASE AGENT TN produced by Wacker Asahikasei Silicone Co., Ltd.)

Higher alcohol alkylene oxide adduct: polyoxyalkylene lauryl ether (DKS NL-Dash410 produced by DKS Co. Ltd.)

[Preparation Method]

The respective components described above were mixed so as to have a composition (parts by mass) described in Tables 1 to 4. An aqueous composition was thus obtained. The basic compound is contained in such a manner that the obtained aqueous composition has a pH shown in Tables 1 to 4. A pH meter (pH METER F-72 produced by HORIBA, Ltd) was used to measure pH of the aqueous compositions.

[Evaluations]

The aqueous compositions produced in a manner described above were evaluated in accordance with a method indicated below.

(Releasability and Lubricity)

The releasability and the lubricity of the aqueous compositions were measured by use of a Lub tester produced by MEC International Co., Ltd.

Specifically, first, a steel sheet of 200 mm×200 mm×30 mm (an SDK-61 member produced by MEC International Co., Ltd.) was heated to 350° C. The aqueous composition was applied over the heated steel sheet by use of an ATOMAX nozzle (a two-fluid nozzle) (AM45B-0ST) produced by ATOMAX Co., Ltd. under a condition of: spray time of 0.5 second; one-time spray; liquid pressure of 0.1 MPa; spray pressure of 0.4 MPa; spray distance of 200 mm; and applied amount of 2.5 g. A cylindrical member (a ring consisting of a S45C member produced by MEC International Co., Ltd.) having an inner diameter of 80 mm, an outer diameter of 100 mm, and a height of 50 mm was placed on the steel sheet over which the aqueous composition had been applied. At that time, the cylindrical member was placed in such a manner that a lower surface orthogonal to a circumferential surface of the cylindrical member comes into contact with the steel sheet.

Next, an aluminum member (ADC-12 produced by ASAHI SEIREN Co., Ltd.) was heated to melt. At that time, the aluminum member was heated until the temperature of the obtained molten metal had reached 670±10° C. This molten metal was manually transferred inside the cylindrical member which had been brought in contact with the steel sheet. The molten metal was thus poured in the cylindrical member while the cylindrical member was in contact with the steel sheet.

Thereafter, the molten metal was solidified by cooling the molten metal naturally. A weight having a weight of 9.0 kg was placed on the aluminum member after solidification. In that state, the cylindrical member was moved toward a direction parallel to a sheet surface direction of the steel sheet. While being moved, a tensile load on the cylindrical member from the beginning of the movement was measured with a load cell attached to the cylindrical member.

The releasability was evaluated using the tensile load at the beginning of the movement. Specifically, when the tensile load at the beginning of the movement was not larger than 5 kgf, the releasability was evaluated as "excellent". When the tensile load at the beginning of the movement was larger than 5 kgf and not larger than 10 kgf, the releasability was evaluated as "good". When the tensile load at the beginning of the movement was larger than 10 kgf and not larger than 20 kgf, the releasability was evaluated as "fair". When the tensile load at the beginning of the movement was larger than 20 kgf, the releasability was evaluated as "poor".

Besides, an average value of the tensile load in three seconds from the beginning of the movement was calculated. The lubricity was evaluated using this average value. Specifically, when the average value was not larger than 5 kgf, the lubricity was evaluated as "excellent". When the average value was larger than 5 kgf and not larger than 10 kgf, the lubricity was evaluated as "good". When the average value was larger than 10 kgf and not larger than 20 kgf, the lubricity was evaluated as "fair". When the average value was larger than 20 kgf, the lubricity was evaluated as "poor".

(Adhesion)

A steel sheet of 100 mm×100 mm×2.5 mm (SUS304 produced by KOBE STAINLESS STEEL CO., LTD.) was heated to 350° C. The heated steel sheet was placed in such a manner that the sheet surface direction becomes horizontal. An aqueous composition was applied over the steel sheet by use of an ATOMAX nozzle (two-fluid nozzle) (AM45B-0ST) produced by ATOMAX Co., Ltd. under a condition of: spray time of 0.25 second, applied amount of 1.5 cc, spray distance of 200 mm, spray pressure of 0.4 MPa, and liquid pressure of 0.1 MPa.

A weight variation in the steel sheet before and after the application was measured. The adhesion was evaluated using the weight variation. Specifically, when the weight variation was 8 mg or more, the adhesion was evaluated as "excellent". When the weight variation was 5 mg or more and less than 8 mg, the adhesion was evaluated as "good". When the weight variation was 2 mg or more and less than 5 mg, the adhesion was evaluated as "fair". When the weight variation was less than 2 mg, the adhesion was evaluated as "poor".

(Heat Resistance)

First, 20 g of aqueous composition was dried at 60° C. for 24 hours. The moisture thus evaporated, and 5 mg of the remained solid was taken up. The taken solid (5 mg) was heated by use of a Simultaneous Thermal Analyzer (TG-DTA/DSC) (STA 6000 produced by PerkinElmer, Inc.) under a condition of gas (air) flow rate of 100 ml/min up to 500° C. at a temperature elevation velocity of 10° C./min. Then, the weight of the solid that was remained after heating (residue amount after heating) was measured. Thereafter, a ratio of the solid weight reduction due to heating to the solid weight before heating [solid weight after heating/solid weight before heating×100](%) was calculated.

When the ratio was 80% or more, the heat resistance was evaluated as "excellent". When the ratio was 50% or more and less than 80%, the heat resistance was evaluated as "good". When the ratio was 20% or more and less than 50%, the heat resistance was evaluated as "fair". When the ratio was less than 20%, the heat resistance was evaluated as "poor".

(Odorousness)

The odorousness was organoleptically evaluated by two examiners during the evaluations of the releasability and the lubricity when the molten metal was transferred inside the cylindrical member having been brought into contact with the steel sheet. Specifically, when neither of two examiners perceived an odor, the odorousness was evaluated as "good". When one of the examiners perceived an odor, or two examiners perceived a little odor, the odorousness was evaluated as "fair". When both the examiners perceived an odor, the odorousness was evaluated as "poor".

The evaluation results are shown in Tables 1 to 4 together with the chemical compositions.

TABLE 1

| | | | Examples | | | | Comparative Examples | | | |
|---|---|---|---|---|---|---|---|---|---|---|
| | | | 1 | 2 | 3 | 4 | 1 | 2 | 3 | 4 |
| Composition (parts by mass) | Carboxylic acid compound | Maleic acid | 5.0 | — | — | — | — | — | — | — |
| | | Fumaric acid | — | 5.0 | — | — | — | — | — | — |
| | | Succinic acid | — | — | 5.0 | — | — | — | — | — |
| | | Adipic acid | — | — | — | 5.0 | — | — | — | — |

TABLE 1-continued

| | | | Examples | | | | Comparative Examples | | | |
|---|---|---|---|---|---|---|---|---|---|---|
| | | | 1 | 2 | 3 | 4 | 1 | 2 | 3 | 4 |
| | | Formic acid | — | — | — | — | 5.0 | — | — | — |
| | | Pelargonic acid | — | — | — | — | — | 5.0 | — | — |
| | | Oleic acid | — | — | — | — | — | — | 5.0 | — |
| | | DL-malic acid | — | — | — | — | — | — | — | 5.0 |
| | | Citric acid | — | — | — | — | — | — | — | — |
| | | L-tartaric acid | — | — | — | — | — | — | — | — |
| | | Oxalic acid | — | — | — | — | — | — | — | — |
| | | Azelaic acid | — | — | — | — | — | — | — | — |
| | | Sebacic acid | — | — | — | — | — | — | — | — |
| | | Dodecanedioic acid | — | — | — | — | — | — | — | — |
| | Basic compound | 30 mass % of sodium hydroxide solution | 11.3 | 11.3 | 11.1 | 8.9 | 14.2 | 4.1 | 2.4 | 9.8 |
| | Silicone | | — | — | — | — | — | — | — | — |
| | Higher alcohol alkylene oxide adduct | | — | — | — | — | — | — | — | — |
| | Water | | 83.7 | 83.7 | 83.9 | 86.1 | 80.8 | 90.9 | 92.6 | 85.2 |
| | pH | | 8 | 8 | 8 | 8 | 8 | 8 | 8 | 8 |
| Evaluations | Releasability | | good | good | good | good | poor | fair | fair | fair |
| | Lubricity | | excellent | excellent | excellent | excellent | poor | good | good | good |
| | Adhesion | | good | good | good | good | good | fair | poor | fair |
| | Heat resistance | | excellent | excellent | excellent | excellent | excellent | good | fair | good |
| | Odorousness | | good | good | good | good | good | poor | good | good |

| | | | Comparative Examples | | | | | | |
|---|---|---|---|---|---|---|---|---|---|
| | | | 5 | 6 | 7 | 8 | 9 | 10 | 11 |
| Composition (parts by mass) | Carboxylic acid compound | Maleic acid | — | — | — | — | — | — | — |
| | | Fumaric acid | — | — | — | — | — | — | — |
| | | Succinic acid | — | — | — | — | — | — | — |
| | | Adipic acid | — | — | — | — | — | — | — |
| | | Formic acid | — | — | — | — | — | — | — |
| | | Pelargonic acid | — | — | — | — | — | — | — |
| | | Oleic acid | — | — | — | — | — | — | — |
| | | DL-malic acid | — | — | — | — | — | — | — |
| | | Citric acid | 5.0 | — | — | — | — | — | — |
| | | L-tartaric acid | — | 5.0 | — | — | — | — | — |
| | | Oxalic acid | — | — | 3.2 | — | — | — | — |
| | | Azelaic acid | — | — | — | 5.0 | — | — | — |
| | | Sebacic acid | — | — | — | — | 5.0 | — | — |
| | | Dodecanedioic acid | — | — | — | — | — | 5.0 | — |
| | Basic compound | 30 mass % of sodium hydroxide solution | 10.2 | 8.7 | 6.6 | 7.0 | 6.5 | 5.7 | — |
| | Silicone | | — | — | — | — | — | — | 6.0 |
| | Higher alcohol alkylene oxide adduct | | — | — | — | — | — | — | 1.0 |
| | Water | | 84.8 | 86.3 | 90.2 | 88.0 | 88.5 | 89.3 | 93.0 |
| | pH | | 8 | 8 | 8 | 8 | 8 | 8 | 8 |
| Evaluations | Releasability | | good | fair | poor | poor | poor | poor | fair |
| | Lubricity | | good | good | poor | poor | poor | poor | good |
| | Adhesion | | good | excellent | good | fair | fair | poor | good |
| | Heat resistance | | good | good | excellent | excellent | excellent | excellent | fair |
| | Odorousness | | poor | fair | good | good | good | good | fair |

TABLE 2

| | | | Examples | | | | Comparative Examples | | |
|---|---|---|---|---|---|---|---|---|---|
| | | | 5 | 6 | 7 | 8 | 12 | 13 | 14 |
| Composition (parts by mass) | Carboxylic acid compound | Phthalic acid | 5.0 | — | — | — | — | — | — |
| | | Isophthalic acid | — | 5.0 | — | — | — | — | — |
| | | Terephthalic acid | — | — | 5.0 | — | — | — | — |
| | | Trimellitic acid | — | — | — | 5.0 | — | — | — |
| | | Benzoic acid | — | — | — | — | 5.0 | — | — |

TABLE 2-continued

| | | | Examples | | | | Comparative Examples | | |
|---|---|---|---|---|---|---|---|---|---|
| | | | 5 | 6 | 7 | 8 | 12 | 13 | 14 |
| | | Salicylic acid | — | — | — | — | — | 5.0 | — |
| | | Gallic acid | — | — | — | — | — | — | 5.0 |
| | Basic compound | 30 mass % of sodium hydroxide solution | 7.8 | 7.8 | 7.8 | 10.2 | 5.4 | 4.7 | 3.8 |
| | Water | | 87.2 | 87.2 | 87.2 | 84.8 | 89.6 | 90.3 | 91.2 |
| | pH | | 8 | 8 | 8 | 8 | 8 | 8 | 8 |
| Evaluations | Releasability | | good | good | good | good | fair | poor | fair |
| | Lubricity | | good | good | good | good | good | poor | fair |
| | Adhesion | | good | good | good | excellent | fair | fair | fair |
| | Heat resistance | | excellent | excellent | excellent | excellent | excellent | fair | fair |
| | Odorousness | | good | good | good | good | good | good | good |

TABLE 3

| | | | Examples | | | | |
|---|---|---|---|---|---|---|---|
| | | | 9 | 10 | 11 | 12 | 13 |
| Composition (parts by mass) | Carboxylic acid compound | Adipic acid | 2.5 | 2.5 | 2.5 | 1.5 | 1.0 |
| | | Terephthalic acid | 2.5 | 2.5 | 2.5 | 1.5 | 1.0 |
| | Basic compound | 30 mass % of sodium hydroxide solution | 8.4 | 8.4 | 8.4 | 3.3 | 1.7 |
| | Water-soluble polymer | CMC | — | 0.1 | — | — | — |
| | | HEC | — | — | 0.1 | — | — |
| | Water | | 86.6 | 86.5 | 86.5 | 93.7 | 96.3 |
| | pH | | 8 | 8 | 8 | 8 | 8 |
| Evaluations | Releasability | | excellent | excellent | excellent | excellent | good |
| | Lubricity | | excellent | excellent | excellent | excellent | good |
| | Adhesion | | good | excellent | excellent | good | fair |
| | Heat resistance | | excellent | excellent | excellent | excellent | excellent |
| | Odorousness | | good | good | good | good | good |

TABLE 4

| | | | Examples | | | | |
|---|---|---|---|---|---|---|---|
| | | | 14 | 15 | 16 | 17 | 18 |
| Composition (parts by mass) | Carboxylic anhydride | Succinic anhydride | 5.0 | — | — | — | — |
| | | Adipic anhydride | — | 5.0 | — | — | — |
| | | Maleic anhydride | — | — | 5.0 | — | — |
| | | Phthalic anhydride | — | — | — | 5.0 | — |
| | Trimellitic anhydride | | — | — | — | — | 5.0 |
| | Basic compound | 30 mass % of sodium hydroxide solution | 13.1 | 10.2 | 13.3 | 8.8 | 11.1 |
| | Water | | 81.9 | 84.8 | 81.7 | 86.2 | 83.9 |
| | pH | | 8 | 8 | 8 | 8 | 8 |
| Evaluations | Releasability | | good | good | good | good | good |
| | Lubricity | | excellent | excellent | excellent | good | good |
| | Adhesion | | good | good | good | good | excellent |
| | Heat resistance | | excellent | excellent | excellent | excellent | excellent |
| | Odorousness | | good | good | good | good | good |

As it can be seen from Tables 1 to 3, the aqueous compositions comprising a carboxylic acid compound represented by the aforementioned formula (1), wherein "R" represents an alkanediyl group having 2 to 4 carbons, a vinylene group, or a benzene ring, and "a" represents 2 or 3; a basic compound; and water (Examples 1 to 13) were excellent in releasability, lubricity, adhesion, and heat resistance, and had a low odorousness. As it can be seen from Table 4, the aqueous compositions comprising: either a carboxylic anhydride represented by the aforementioned formula (2), wherein "R" represents an alkanediyl group having 2 to 4 carbons, a vinylene group, or a benzene ring or a trimellitic anhydride; a basic compound; and water (Examples 14 to 18) were excellent in releasability, lubricity, adhesion, and heat resistance, and had a low odorousness.

In contrast, in the cases of containing a carboxylic acid compound other than the carboxylic acid compound, the carboxylic anhydride, and the trimellitic anhydride (Comparative Examples 1 to 10 and 12 to 14), the aqueous compositions were inferior in releasability, lubricity, adhesion, or heat resistance, or had a high odorousness compared with Examples 1 to 18. Further, in the case of containing a silicone and a higher alcohol alkylene oxide adduct (in Comparative Example 11), the aqueous composition was inferior in releasability, lubricity, adhesion, or heat resistance, and had a little odor.

Further, the coloring resistance was evaluated.

(Coloring resistance)

The surface of the solidified aluminum material after evaluation of the releasability and the lubricity, the surface having been in contact with the steel sheet was confirmed by sight. As a result, when the coloration was not observed, the coloring resistance was evaluated as "good", and when the coloration was observed, the coloring resistance was evaluated as "poor".

The results are shown in Table 5 together with the kinds of carboxylic acid compounds used.

TABLE 5

| | Examples | | | | | | |
|---|---|---|---|---|---|---|---|
| | 1 | 2 | 3 | 4 | 5 | 6 | 7 |
| Carboxylic acid compound | Maleic acid | Fumaric acid | Succinic acid | Adipic acid | Phthalic acid | Isophthalic acid | Terephthalic acid |
| Coloring resistance | poor | poor | poor | good | poor | poor | good |

| | Examples | | | | | Comparative Example |
|---|---|---|---|---|---|---|
| | 8 | 9 | 10 | 11 | 12 | 8 |
| Carboxylic acid compound | Trimellitic acid | Adipic acid + Terephthalic acid | Adipic acid + Terephthalic acid | Adipic acid + Terephthalic acid | Adipic acid + Terephthalic acid | Azelaic acid |
| Coloring resistance | good | good | good | good | good | poor |

As it can be seen from Table 5, it was found possible to obtain a molded product not only excellent in releasability, lubricity, adhesion, and heat resistance, and having a low odorousness, but also not being colored when using an adipic acid, a terephthalic acid, a trimellitic acid, and a mixture thereof as a carboxylic acid compound.

This application is based on Japanese Patent Application No. 2018-120685 filed on Jun. 26, 2018, the contents of which are incorporated in the present application.

While the present invention has been fully and appropriately described in the above by way of embodiments in order to express the present invention, it is to be recognized that those skilled in the art can readily change and/or modify the embodiments described above. Therefore, it is to be construed that the changes or modifications made by those skilled in the art are encompassed within the scope of the claims unless those changes or modifications are at a level that departs from the scope of the claims described in the claims section of the present application.

INDUSTRIAL APPLICABILITY

According to the present invention, an aqueous composition excellent in releasability, lubricity, adhesion, and heat resistance, and having a low odorousness is provided.

The invention claimed is:

1. An aqueous composition comprising:

adipic acid;

terephthalic acid;

sodium hydroxide; and water, wherein a content of the adipic acid is 1.0 mass % or more, a content of the terephthalic acid is 1.0 mass % or more, and a total content of the adipic acid and the terephthalic acid is 3 to 15 mass % to a total amount of the aqueous composition, and the aqueous composition contains the sodium hydroxide, as a sole base, in an amount such that the aqueous composition has a pH of 7 to 10.

2. The aqueous composition according to claim 1, wherein the total content of the adipic acid and the terephthalic acid is 3 to 5 mass % to the total amount of the aqueous composition.

* * * * *